United States Patent [19]

Czerepinski et al.

[11] 4,088,482

[45] May 9, 1978

[54] ORGANIC PHOTOCONDUCTING COMPOSITIONS CONTAINING AROMATIC SULFONYL FLUORIDES AND THEIR USE IN ELECTROPHOTOGRAPHIC PROCESSES

[75] Inventors: Ralph G. Czerepinski, Holliston; Jeffrey K. Hecht, Framingham, both of Mass.; Thomas T. Chiu, Midland, Mich.

[73] Assignee: The Dow Chemical Company, Midland, Mich.

[21] Appl. No.: 162,307

[22] Filed: Jul. 13, 1971

[51] Int. Cl.[2] ..... G03G 5/09

[52] U.S. Cl. ..... 96/1.5 R; 96/1.6

[58] Field of Search ..... 96/1.5, 1.6; 252/501

[56] References Cited

U.S. PATENT DOCUMENTS

| | | | |
|---|---|---|---|
| 2,778,813 | 1/1957 | Gaspar et al. | 96/74 |
| 3,257,202 | 6/1966 | Schlesinger et al. | 96/1.5 |
| 3,287,123 | 11/1966 | Hoegl | 96/1.5 |
| 3,567,440 | 3/1971 | Kasche | 96/1.5 |
| 3,627,524 | 12/1971 | Kinjo et al. | 96/1.5 |
| 3,660,084 | 5/1972 | Vanheertum et al. | 96/1.5 X |

FOREIGN PATENT DOCUMENTS

| | | | |
|---|---|---|---|
| 1,457,158 | 10/1966 | France | 96/74 |

OTHER PUBLICATIONS

Cotton et al., Advanced Inorganic Chemistry, 1966, pp. 100–104 and 107–111.

Handbook of Chemistry and Physics, 1956, p. 2339.

Chemical Abstracts, vol. 66, 1967, 120801w.

*Primary Examiner*—Dennis E. Talbert, Jr.

*Assistant Examiner*—John R. Miller

*Attorney, Agent, or Firm*—L. Wayne White

[57] ABSTRACT

Photoconductive compositions containing aromatic sulfonyl fluorides are novel compositions which are useful in electrophotographic processes, such as xerography. E.g., an electrostatic copying paper is obtained by coating an electroconductive base paper with a composition comprising poly(N-vinylcarbazole) and 4,4'-biphenyldisulfonyl fluoride.

20 Claims, No Drawings

ORGANIC PHOTOCONDUCTING COMPOSITIONS CONTAINING AROMATIC SULFONYL FLUORIDES AND THEIR USE IN ELECTROPHOTOGRAPHIC PROCESSES

BACKGROUND OF THE INVENTION

Electrophotography is the electrical recording of information in the form of a two-dimensional optical image. Electrophotographic processes, such as xerography, normally use materials consisting of a support coated with a photoconductive substance(s). Such processes operate by virtue of the fact that the photoconductive substance(s) is normally an electrical insulator in the dark (having a specific resistivity of about $10^{15}$ ohm-cm.) and becomes a semiconductor in the presence of light (having a specific resistivity of about $10^{11}$ ohm-cm.).

Thus, in electrophotographic processes, the photoconductive layer is charged either positively or negatively in the dark and light is then impinged on the charged surface through a master or an image of the master is projected onto the charged surface. In those areas where light strikes, the surface becomes electrically conductive and allows the surface charge to dissipate into the electroconductive support. Where no light strikes the charged surface, the electrostatic charge remains in the form of a latent image. This remaining image is then developed by powdering (or otherwise contacting) the surface with a pigment (toner) bearing the opposite charge. Both positive and negative images can be obtained by the appropriate choice of master and toner.

Inorganic compounds, such as seleniumm and zinc oxides, as well as various organic compounds, such as anthracene, carbazoles, poly(N-vinylcarbazole), etc., have been previously used as photoconductors in electrophotography. The organic materials have many advantages; e.g. they are in most instances soluble in conventional solvents and may be easily cast as films, etc.

An extensive technical and literature review of electrophotography and the various organic photoconductors useful therein is entitled "Organic Photoconductors in Electrophotography" by L. I. Grossweiner (published and sold by M/K Systems; Marblehead, Mass. (1970)).

One of the primary problems associated with organic photoconductors in electrophotography is their low photosensitivity (i.e., their low rate of decay of electrical potential when illuminated). Many compounds have been used as "activators" in combination with such organic photoconductors to improve their photosensitivity, as illustrated by L. I. Grossweiner cited above. The effective activators generally discolored the photoconductor and thus rendered the system unsatisfactory in direct electrostatic copying processes and the like which require an essentially colorless system.

SUMMARY OF THE INVENTION

We have now discovered that aromatic sulfonyl fluorides are unusually effective activators for organic photoconductors and that they impart little or no color to said photoconductors. The combinations of (a) an organic photoconductor and (b) an aromatic sulfonyl fluoride are novel compositions which are useful in electrophotography processes, particularly xerography.

THE ACTIVATORS

The aromatic sulfonyl fluorides form a known class of compounds bearing from 1 to about 4 (and preferably 2) sulfonyl fluoride groups ($-SO_2F$) per aromatic nucleus. Such aromatic nuclei generally have from 6 to about 30 carbon atoms (preferably from 6 to about 14 carbon atoms). Any member of this known class may be suitably used herein. Examples of suitable such compounds include fluorosulfonyl-substituted: benzenes (such as 1,3- or 1,4-bis(fluorosulfonyl)benzene, 1,3,5-tris(fluorosulfonyl)benzene, etc.); chalcones (such as 4-fluorosulfonylchalcone, 4,4'-bis(fluorosulfonyl)chalcone, etc.); naphthalenes (such as 1-fluorosulfonylnaphthalene, 1,4-bis(fluorosulfonyl)naphthalene, 1,4,5,8-tetra(fluorosulfonyl)naphthalene, etc.); fluorenones (such as bis(fluorosulfonyl)fluorenone, etc.); anthracenes (such as 1,3-, 1,4-, 1,5-and 2,6-bis(fluorosulfonyl)anthracene, 1,4,5,8-tetra(fluorosulfonyl)anthracene, etc.); phenanthrenes (such as 1-fluorosulfonylphenanthrene, 2,7-bis(fluorosulfonyl)phenanthrene, etc.); oligophenylenes (such as 2-fluorosulfonylbiphenyl, 4,4'-bis(fluorosulfonyl) biphenyl, 4,4''-bis(fluorosulfonyl)terphenyl, etc.); stilbenes (such as fluorosulfonylstilbene, etc.); indenes (such as 4-fluorosulfonylindene, etc.); phenalenes (such as 1,3-bis(fluorosulfonyl)phenalene, 2,5,8-tris(fluorosulfonyl)phenalene, etc.); and other like fluorosulfonyl-substituted polynuclear aromatic hydrocarbons including the analogous fluorosulfonyl-substituted heterocyclic compounds having atom(s) of nitrogen, oxygen and/or sulfur included with the aromatic ring(s) (e.g. the fluorosulfonyl-substituted pyridines, quinolines, sym-triazines, benzothiophenes, acridines, etc.). Likewise suitable are homopolymers and interpolymers having aromatic sulfonyl fluoride groups (such as polymers of fluorosulfonyl styrene, fluorosulfonylvinyltoluene, etc.). It will be understood that the aromatic nucleus can additionally bear one or more inert substituents, such as alkyl, aryl, alkenyl, aralkyl, alkaryl, halo, carboxyl, acetyl, benzoyl, cyano, halo-substituted hydrocarbons, cyano, nitro, sulfonyl, alkylsulfonyl, arylsulfonyl, amino, alkoxy, aryloxy, alkylthio, aralkylthio, hydroxyl, mercapto, and the like. As a general observation, best results are generally obtained when the nucleus of the aromatic sulfonyl fluorides is rendered relatively electron deficient by the presence of the electron-withdrawing fluorosulfonyl group(s).

Thus, the preferred aromatic sulfonyl fluorides are those which bear no other substituents or which bear alkylsulfonyl, arylsulfonyl, halo-substituted hydrocarbon, nitro, cyano, halo, alkyl, aryl, alkenyl, aralkyl or alkaryl groups. It has also been noted that the presence of ionic groups (such as sulfonyl, carboxyl, etc.) and/or groups which are capable of hydrogen bonding (such as hydroxyl, mercaptan, hydroxyalkyl, etc.) frequently leads to a lowering of the dark resistivity of the photoconductors.

THE PHOTOCONDUCTORS

The organic photoconductors are likewise a well known class of compounds. They are typically monomeric or polymeric polynuclear aromatic compounds and in many instances bear one or more hetero atoms (oxygen, sulfur or nitrogen) as a member of the ring. Examples of such compounds include naphthalene, poly(vinylnaphthalene), anthracene, poly(9-vinylanthracene),carbazoles, such as the N-alkylcarbazoles (e.g. N-ethylcarbazole, N-butylcarbazole, etc.) and poly(N-vinylcarbazole). Such listing being incorporated herein by reference to same. Anthracene, poly(vinylanthracene) and poly(N-vinylcarbazole) are the best known and are the currently preferred photoconductors for use herein. An inert polymerizable or polymeric binder is used when the photoconductor is monomeric; e.g. polystyrene, polyacrylates, etc. are useful as binders.

The sensitivity of the photoconductive coatings in the range of visible light can be increased by the addition of optical sensitizers, in particular, dyestuffs. Examples of which include triarylmethane dyestuffs such as Brilliant Green, Victoria Blue B, Methyl Violet, Ethyl Violet, Crystal Violet, Acid Violet 6B; xanthene dyestuffs, namely rhodamines, such as Rhodamine B, Rhodamine 6G, Rhodamine G Extra, Sulphorhodamine B and Fast Acid Eosin G, as also phthaleins such as Eosin S, Eosin A, Erythrosin, Phloxin, Rose Bengal, and Fluorescein; thiazine dyestuffs such as Methylene Blue; acridine dyestuffs such as Acridine Yellow, Acridine Orange and Tryptaflavine, quinoline dyestuffs such as Pinacyanol and Cryptocyanine; quinone dyestuffs and ketone dyestuffs such as Alizarin, Alizarin Red S, and Quinalizarine; cyanine dyestuffs, e.g., Cyanine and chlorophyll.

To form the novel electrophotographic compositions, one merely combines (i.e., mixes, blends or disperses) an aromatic sulfonyl fluoride (or mixture thereof) with an organic photoconductor (or mixture thereof). This is conveniently accomplished in a mutual, inert solvent or as a dispersion in an inert liquid medium.

The aromatic sulfonyl fluoride activators are generally used in said electrophotographic compositions in amounts of from about 1 to about 80 percent by weight, total weight basis, and is preferably used in amounts of from about 25 to about 75 percent by weight.

As stated above, these electrophotographic compositions are useful in many conventional electrophotographic processes such as xerography. The compositions described herein are generally applied as coatings to a support by conventional techniques, e.g. a solution of the compositions may be cast, painted, sprayed (etc.) upon a support and the solvent evaporated. Coatings of from about 0.05–25.0 microns in thickness are common (0.1 to 10.0 microns preferred). The products may also be applied as aqueous or non-aqueous dispersions. The articles and types of support materials used in electrophotography are well known and include: metals, such as aluminum, magnesium, zinc and copper; cellulosics, such as paper and cellulose hydrate; plastics, such as polyamides (e.g. nylon 66), polyesters (e.g. polyethylene terephthlate), polyurethanes, polyvinylalcohols, polycarbonates, polyolefins (e.g. polyethylene, polystyrene, styrene/butadiene copolymers), and the like. In general, such support materials themselves are electrical conductors or semi-conductors (having a specific resistivity in the neighborhood of $10^{12}$ ohm-cm. or less). Support materials, such as the plastics, which have a high resistivity are commonly coated with an intermediate layer which is more conductive (such as silver or aluminum) prior to applying the subject compositions.

In the latter instance, articles useful as slides, microfilm, etc. are prepared.

EXAMPLES

The following examples further illustrate the invention. Each example is a combination of an aromatic sulfonyl fluoride and an organic photoconductor. The examples were evaluated pursuant to either Method A or Method B detailed below.

METHOD A

A solution of (a) an aromatic sulfonyl fluoride activator and (b) a polymeric photoconductive substance in a suitable inert solvent (generally $CHCl_3$) was applied as a thin film to an electrically conductive substrate (aluminum foil or Weyerhaeuser "EC Base Stock A ®"). The solvent was removed under ambient conditions. The coated samples were then held in the dark for a period of a few minutes to several days. Evaluation of the samples was performed in a Most Stati-Tester ®, a product of M/K Systems, using a light source filtered to about 20 foot-candles or a similar rotating disc electrometer designed after E. C. Giamo, RCA Reviews 22 (4): 780 (1961). Thus, the treated sample was charged to a maximum voltage and allowed to dark decay for 20–30 sec. (generally, an equilibrium was reached), the charge measured in volts, the light source was turned on, and the half-time ($t\ \frac{1}{2}$) of the photo-induced charge decay measured in seconds. The results of a series of experiments are tabulated in Table I below. The amount of sulfonyl fluoride used is reported as parts by weight per 100 parts of polymeric photoconductive substrate.

METHOD B

In like manner, a solution of (a) a sulfonyl fluoride, (b) a monomeric photoconductive substance and (c) a polymeric binder in a suitable solvent (generally $CHCl_3$) was applied to a conductive substrate and evaluated as above. The results of a series of experiments are tabulated in Table II below. All amounts are parts by weight per 100 parts of conductive substrate.

The photoconductive compositions were evaluated according to the following procedure:

Sample Preparation: A total of 600 to 900 mg. of the test composition were dissolved in 10 ml of solvent (e.g. tetrahydrofuran). The solution was coated on a sheet of aluminum foil (which was pre-cleaned with acetone) with a draw-down bar of 8 mil gap. The coated specimen was air dried and maintained in the dark for Photoresponse Measurement: A rotating disk electrometer as described by Giamo, E. C., RCA Reviews, 22 (4): 780 (1961) was used to carry out electrophotographic charge decay measurements. This is a conventional method for characterizing electrophotographic substance. A one square inch sample of the coated specimen prepared by the above procedure was mounted on the turntable of said electrometer. The turntable was rotated in continued darkness at 360 r.p.m. and a 6,000 volt corona discharging device was activated for 10 seconds. The charge received by the specimen was continuously monitored by a pickup sensor leading to a dynamic capacity electrometer (Victoreen Model 475A). The filtered output signal was recorded. After 20 seconds dark-decay, a 60 foot-candle tungsten light was shined on the specimen causing light-charge-decay. The charges on the specimen as detected by the dynamic capacitor electrometer were calibrated against a standard voltage source. The rate of the light-charge-decay is expressed in Tables I and II a $t\ \frac{1}{2}$ values in seconds. The better the photoconductor is, the faster is the rate of light decay and the lower $t\ \frac{1}{2}$ is. The total voltage accepted by the coated specimen is expressed under the heading "Volts" in Tables I and II.

Table I

| Ex. | Photo-con-duc-tor | Sulfonyl Fluoride (pts.) | Volts | t ½ (sec.) |
|---|---|---|---|---|
| 1 | PVK | 1,5-NDSF (76) | 370 | 1 |
| 2 | " | 2,7-NDSF (76) | 340 | 1 |
| 3 | " | 1,3,5-BTSF (84) | 620 | 1 |
| 4 | " | 3,6-DBF (100) | 120 | 22 |
| 5 | " | 4-TSF (100) | 420 | 44 |
| 6 | " | FDSF (100) | 410 | 1 |
| 7 | " | 1,3-BDSF (17) | 470 | 1.5 |
| 8 | " | 1,3-BDSF (34) | 520 | 0.5 |
| 9 | " | α-NSF (100) | 280 | 10 |
| 10 | " | $C_6HCl_2—SO_2F$ (50) | 280 | 10 |
| 11 | " | $1,4-C_6H_4(SO_2F)_2$ (100) | 200 | 15 |
| 12 | " | $1,4-HO_2C—C_6H_4—SO_2F$ (100) | 125 | 44 |
| 13 | " | $3-(SO_2F)—C_6H_4—\overset{O}{\overset{\|\|}{C}}—CH_3$ (100) | 175 | 15 |
| 14 | " | $2,4-(SO_2F)_2—C_6H_3—OH$ (60) | 100 | 6 |
| 15 | " | CPQSF (100) | 90 | 4 |
| 16 | PAN | BPDSF (100) | 80 | 30 |
| 17 | PAN | 2,7-NDSF (50) | 135 | 12 |
| 18 | PAN | CPQSF (100) | 170 | 16 |

In Tables I and II: 1,5- and 2,7-NDSF is 1,5- and 2,7-naphthalene disulfonyl fluoride, respectively; 1,3,5-BTSF is 1,3,5-benzene trisulfonyl fluoride; 3,6-DBF is dibenzofuran disulfonyl fluoride; 4-TSF is 4-tolyl sulfonyl fluoride; FDSF is fluorenone disulfonyl fluoride; 1,3-BDSF is 1,3-benzene disulfonyl fluoride; α-NSF is α-naphthalene sulfonyl fluoride; CPQSF is 4-chloro-2-phenyl-6-quinoline sulfonyl fluoride; BPDSF is 4,4'-biphenyl disulfonyl fluoride; PVK is poly(N-vinylcarbazole); and PAN is polyacenaphthalene. Examples 1–8, a filtered light source of 60 foot-candles was used, and, a filtered light source of 20 foot-candles was used in Examples 9–18.

Table II

| Ex. | Photo-conductor | Sulfonyl Fluoride (pts.) | Binder (pts.) | Volts | t ½ (Sec.) |
|---|---|---|---|---|---|
| 1 | anthracene | BPDSF (60) | PVT (67) | 100 | 0.7 |
| 2 | anthracene | BPDSF (167) | PVT (33) | 210 | 0.6 |
| 3 | anthracene | BPDSF (167) | t-BS (33) | 70 | 1 |
| 4 | anthracene | BPDSF (100) | PS (33) | 70 | 1 |
| 5 | TBP | BPDSF (24) | PS (71) | 235 | 6 |
| 6 | N-VK | BPDSF (41) | PS (100) | 740 | 24 |
| 7 | N-EtK | BPDSF (41) | PS (100) | 390 | 44 |
| 8 | DBTP | BPDSF (60) | PVT (40) | 610 | 22 |
| 9 | DBTP | 1,3,5-BTSF (60) | PVT (40) | 320 | 21 |
| 10 | PA | 1,3,5-BTSF(60) | PVT (40) | 260 | 11 |
| 11 | BPDP | 1,5-NDSF (60) | PVT (40) | 590 | 32 |
| 12 | phenoxathiin | 1,3,5-BTSF (60) | PVT (40) | 480 | 68 |
| 13 | dibenzofuran | BPDSF (60) | PVT (40) | 500 | 23 |
| 14 | anthracene | BPDSF (100) | PS (100) | 220 | 6 |
| 15 | p-terphenyl | BPDSF (100) | PS (100) | 660 | 150 |
| 16 | DBA | BPDSF (100) | PS (100) | 135 | 40 |
| 17 | phenanthrene | BPDSF (100) | PS (50) | 530 | 50 |
| 18 | pyrene | BPDSF (100) | PS (50) | 230 | 24 |
| 19 | stilbene | BPDSF (100) | PS (50) | 300 | 60 |
| 20 | DPB | BPDSF (100) | PS (50) | 225 | 12 |
| 21 | DPA | BPDSF (50) | PS (200) | 630 | 40 |
| 22 | MOA | BPDSF (100) | PS (83) | 440 | 150 |

In Table II, TBP is N,N,N', N'-tetrabenzyl-p-phenylenediamine; N-VK is N-vinylcarbazole; N-EtK is N-ethylcarbazole; DBTP is dibenzothiophene; PA is 9-phenylanthracene; BPDP is 2,5-bis(4-bromophenyl)-3,4-diphenyl; DBA is 9,10-dibromoanthracene; DPB is 1,4-diphenylbutadiene; DPA is 9,10-diphenylanthracene; MOA is 9-methoxyanthracene; PVT is polyvinyltoluene; t-BS is poly(4-(t-butyl)styrene); and PS is polystyrene. A filtered light source of 60 foot-candles was used in Examples 1–13, and, a filtered light source of 20 footcandles was used in Examples 14–22.

The compositions prepared above were successfully used in imaging tests on aluminum, tin-oxide sputtered glass, cadmium-oxide sputtered and aluminum-coated polyester films (Mylar®), electroconductive paper (Weyerhaeuser "A") and other such substrates. E.g., a 6.2 weight percent solution of 4,4'-biphenyl disulfonyl fluoride/poly(N-vinylcarbazole), 1:5 molar ratio, in tetrahydrofuran was coated onto a tin oxide-sputtered glass plate with a draw bar (5 mil gap). The coated plate was allowed to dry overnight. The coated plate was then subjected to a positive corona discharge of approximately 6,000 volts and a photographic negative (white letters on black background was placed on top of the charged plate and exposed to 60 foot-candle tungsten light source for 1 second. The exposed plate was toned with a conventional dry toner and the toner fixed (or set) with heat. A slide of black letters on a transparent background was thus obtained. The quality of the letters was excellent. Similar results were obtained on other electrically conductive substrates.

We claim:

1. An organic photoconductor in admixture with an activating amount of at least one aromatic sulfonyl fluoride, said aromatic sulfonyl fluoride having a polynuclear aromatic hydrocarbon nucleus and having from 1 to 4 sulfonyl fluoride groups per aromatic nucleus and a total carbon content of from 6 to about 30 carbon atoms.

2. The composition defined in claim 1 wherein said aromatic sulfonyl fluoride has a total carbon content of from 6 to 14 carbon atoms.

3. The composition defined by claim 1, wherein said aromatic sulfonyl fluoride has 2 sulfonyl fluoride groups per aromatic nucleus.

4. The composition defined by claim 1 dissolved or dispersed in an inert liquid.

5. The composition defined by claim 1 wherein said aromatic nucleus bears only hydrogen and from 1 to 4 sulfonyl fluoride groups.

6. The composition defined by claim 5 wherein said aromatic sulfonyl fluoride has 2 sulfonyl fluoride groups per aromatic nucleus.

7. The composition defined by claim 1 wherein said photoconductor is a monomeric or polymeric vinylcarbazole or a vinylanthracene, carbazole, anthracene or an inertly-substituted carbazole or anthracene, with the proviso that if non-polymeric, the composition shall be incorporated in an inert polymerizable or polymeric binder.

8. The composition defined by claim 7 wherein said photoconductor is poly(N-vinylcarbazole), poly(9-vinylanthracene), or anthracene.

9. In a electrophotographic process for reproducing an image by exposing an electrostaticaly charged, supported photoconductive layer to light under a master or a reflected image of said master to produce a latent image and developing the resulting latent image with a toner, the improvement consisting of using the composition defined by claim 1 as said photoconductive layer.

10. The improved process defined by claim 9 wherein said electrophotographic process is a xerographic process.

11. A solid electroconductive support article coated with the composition defined by claim 1.

12. The coated article defined by claim 11 wherein said article is paper, an organic polymer, glass or metal.

13. The coated article defined by claim 12 wherein said article is paper.

14. The coated article defined by claim 12 wherein said article is an organic polymer film.

15. An organic photoconductor in admixture with an activating amount of at least one aromatic sulfonyl fluoride, said aromatic sulfonyl fluoride being benzene bis- or tris(sulfonyl fluoride) or biphenyl bis(sulfonyl fluoride) or naphthalene bis(sulfonyl fluoride) or a mixture thereof.

16. The composition defined by claim 15 wherein said photoconductor is a monomeric or polymeric vinylcarbazole or a vinylanthracene, carbazole, anthracene or an inertly-substituted carbazole or anthracene, with the proviso that if non-polymeric, the composition shall be incorporated in an inert polymerizable or polymeric binder.

17. The composition defined by claim 16 wherein said aromatic sulfonyl fluoride is 4,4'-biphenyl bis(sulfonyl fluoride) and said photoconductor is poly(N-vinylcarbazole), poly(9-vinylanthracene), or anthracene.

18. A solid electroconductive support article coated with the composition defined by claim 17.

19. A solid electroconductive support article coated with the composition defined by claim 16.

20. A method of increasing the photosensitivity of an organic photoconductor comprising mixing said organic photoconductor with an activating amount of at least one aromatic sulfonyl fluoride, said aromatic sulfonyl fluoride having a polynuclear aromatic hydrocarbon nucleus and having from 1 to 4 sulfonyl fluoride groups per aromatic nucleus and a total carbon content of from 6 to about 30 carbon atoms.

* * * * *